United States Patent [19]

Gmelin et al.

[11] 4,370,967

[45] Feb. 1, 1983

[54] FUEL INJECTION SYSTEM

[75] Inventors: Karl Gmelin, Ingelfingen; Peter Stiefel, Ditzingen; Klaus-Jürgen Peters, Affalterbach, all of Fed. Rep. of Germany

[73] Assignee: Robert Bosch GmbH, Stuttgart, Fed. Rep. of Germany

[21] Appl. No.: 59,361

[22] Filed: Jul. 20, 1979

[30] Foreign Application Priority Data

Sep. 27, 1978 [DE] Fed. Rep. of Germany ..... 2841920

[51] Int. Cl.[3] ..... F02M 69/00

[52] U.S. Cl. ..... 123/452; 123/461; 123/516

[58] Field of Search ..... 123/452, 453, 454, 455, 123/461, 514, 516

[56] References Cited

U.S. PATENT DOCUMENTS

| | | | |
|---|---|---|---|
| 3,951,119 | 4/1976 | Jaggle | 123/455 |
| 3,974,809 | 8/1976 | Stumpp | 123/455 |
| 4,007,722 | 2/1977 | Knapp | 123/453 |
| 4,132,211 | 2/1979 | Wilfert | 123/454 |
| 4,182,298 | 1/1980 | Greiner | 123/454 |
| 4,284,048 | 8/1981 | Shelhas | 123/454 |

*Primary Examiner*—P. S. Lall
*Assistant Examiner*—Carl Stuart Miller
*Attorney, Agent, or Firm*—Edwin E. Greigg

[57] ABSTRACT

A fuel injection system is proposed which serves to supply fuel to a mixture-compressing, externally ignited internal combustion engine. The fuel injection system includes an air flow rate member, which actuates a metering and distribution valve. A reservoir is disposed in a pressure control line which branches off from a fuel supply line, by means of which reservoir a flushing valve can be affected in such a manner that below a certain fuel pressure in the pressure control line the flushing valve is opened, as a result of which the fuel supplied to the individual injection valves can flow back through outflow lines to the fuel tank and thus closes the flushing valve above the certain fuel pressure. Above the certain fuel pressure, the electrical circuit of the starter motor is simultaneously closed. Thus, upon starting the engine, all the lines and units of the fuel injection system are filled with fuel, so that a secure start is assured.

15 Claims, 2 Drawing Figures

FUEL INJECTION SYSTEM

BACKGROUND OF THE INVENTION

The invention relates to a fuel injection system of the type described herein and finally claimed. A fuel injection system is already known in which a spring reservoir is provided in the fuel supply line for the purpose of preventing vapor bubbles after the internal combustion engine is turned off and to compensate for volumetric changes when the engine temperature is dropping after the engine is turned off or volumetric changes caused by leakage of fuel out of the system. However, in such a system there is the disadvantage that the reservoir volume cannot be made to be as large as desired, so that when the fuel injection system is not in operation the movable reservoir element contacts its end stop after a relatively short time, and further vapor bubble information can no longer be prevented and a further compensation for a lessening in fuel volume is no longer possible. This often causes misfiring, in the event of restarting of the internal combustion engine, until such time as the system is again completely filled with fuel.

OBJECT AND SUMMARY OF THE INVENTION

The fuel injection system in accordance with the invention has the advantage over the prior art that the fuel injection system is filled with fuel before the starter motor of the internal combustion engine is actuated, so that a more secure start is assured for the internal combustion engine.

As a result of the features described in the dependent claims, further advantageous embodiments and improvements of the fuel injection system given in the main claim are possible.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
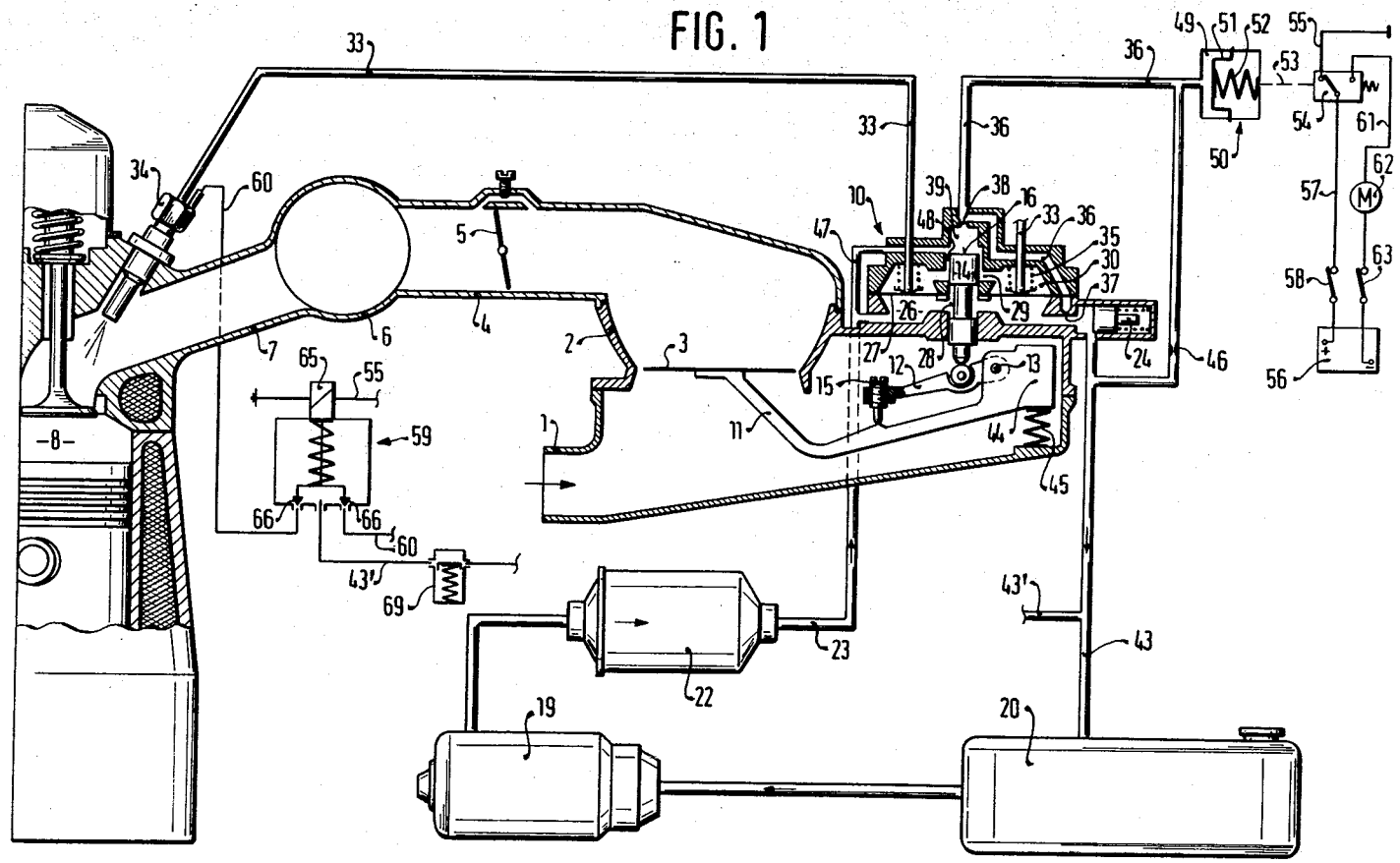
FIG. 1 shows a first exemplary embodiment of a fuel injection system.

Turning now to FIG. 1, there will be seen a first embodiment of a fuel injection system including an intake manifold 1 having a conical section 2 which contains an air flow rate member 3 beyond which there is located an induction tube region 4 containing an arbitrarily settable throttle valve 5. Intake air flows through the induction tube in the direction of the arrow to one or more cylinders 8 of an internal combustion engine.

In the present case, the air flow rate member 3 is a baffle plate disposed transversely with respect to the direction of air flow and capable of displacement within the conical region 2 of the induction tube in accordance with a certain function of the air flow rate through the tube. The air pressure between the air flow rate member 3 and the throttle valve 5 will be constant provided that the restoring force acting on the air flow rate member 3 is constant and that the air pressure ahead of the member 3 is also constant. The air flow rate member 3 controls the opening of a metering and distribution valve assembly 10. The air flow rate member 3 includes a main operating lever 11 and an auxiliary or correction lever 12. The motion of the air flow rate member 3 is transmitted by the operating lever 11 which is pivoted on the same shaft 13 as the correction lever 12 and which actuates the control slide 14 which is the movable member of the metering and distribution valve assembly 10. A mixture control screw 15 permits an adjustment of the desired fuel-air mixture.

Fuel is supplied by an electric fuel pump 19 which aspirates the fuel from a fuel tank 20 and delivers it through a storage container 21, a filter 22 and a fuel line 23 to the fuel metering and distribution assembly 10. A fuel system pressure controller 24 maintains the system pressure in the fuel injection system constant.

The fuel supply line 23 splits into several branches which lead to first chambers 26 of the fuel valve assembly 10, whereby one side of a diaphragm 27 in each chamber is affected by fuel pressure. The first chambers 26 also communicate with an annular groove 28 of the control slide 14. Depending on the axial position of the control slide 14, the annular groove overlaps control slits 29 to varying degrees permitting fuel to flow into second chambers 30 which are divided from the first chambers 26 by the diaphragm 27. From the second chambers 30, fuel flows through fuel injection lines 33 to the individual injection valves 34 which are located in the vicinity of the engine cylinders 8 in the induction tube region 7. The diaphragm 27 is the movable valve member of a control valve which is held open by a spring 35 when the fuel injection system is not operating. The diaphragm boxes defined, in each case, by a chamber 26 and a chamber 30, insure that the pressure drop at the metering valve 28, 29 is substantially constant independently of the relative overlap between the annular groove 28 and the control slits 29, i.e., independently of the fuel quantity flowing to the injection valves 34.

During a pivoting displacement of the operating lever 11, the air flow rate member 3 is moved into the conical region 2 so that the varying annular cross section between the flow rate member and the conical wall has a certain function with respect to the displacement of the air flow rate member 3.

The restoring force exerted on the control slide 14 and thus on the air flow rate member 3 may be generated by means of a compression spring 45, which is supported on the air flow rate member housing and urges the air flow rate member 3 in the closing direction. However, it is also sufficient to have an agreement between the lever weight and a compensation weight 44 on the other side of the pivot point 13. A control pressure line 36 branches off from the fuel supply line 23 downstream of the first chamber 26 of the control valves 26, 30, 33, which line 36 is separated from the fuel supply line 23 by an uncoupling throttle 37. A pressure chamber 39 communicates via a damping throttle 38 with the control pressure line 36 and the control slide 14 which includes a front face 16 projecting into this pressure chamber 39.

Downstream of the damping throttle 38 a further throttle restriction 46 is provided in the control pressure line 36, through which the fuel can flow out of the control pressure line 36, without pressure, into a return flow line 43 and from there back to the fuel tank 20. The pressure of the fuel in the pressure chamber 39, first, generates a restoring force on the air flow rate member 3 and, second, serves to damp the adjustment movement of the air flow rate member 3.

When the internal combustion engine is being turned off, the control slide 14 of the fuel metering and distribution valve 10 is displaced by the compression spring 45, via the air flow rate member 3, into a position in which the control slits 29 are closed by the control slide 14 but the front face 16 of the control slide 14 opens a flushing line 47, which branches off from the fuel supply line 23 and discharges into the pressure chamber 39. At the same time, the front face 16 of the control slide 14, in this position, opens flushing channels 48, which connect the pressure chamber 39 with each second chamber 30 of the control valves. Upstream of the further throttle restriction 46, a reservoir chamber 49 of a hydraulic reservoir 50 having a movable reservoir or diaphragm member 51, which acts counter to a compression spring 52, is connected with the control pressure line 36. The movable reservoir member 51, as shown by the broken line 53, is coupled with an electric pressure switch 54, which in the illustrated position closes an electrical circuit 55, which is in contact with the vehicle battery 56. The ignition switch 58 of the internal combustion engine is disposed in the connecting line 57 between the vehicle battery 56 and the pressure switch 54.

Now, looking to the left of FIG. 1, an electromagnet 65 is disposed in the electrical circuit 55 which in the illustrated position of the previously mentioned pressure switch 54, in which the electrical circuit 55 is in contact with the vehicle battery 56, is energized and thus moves the movable valve parts 66 of the flushing valve 59 in the opening direction. The flushing valve 59 controls discharge lines 60, which branch off from each injection valve 34 and when the flushing valve 59 is opened, discharge via the return flow lines 43', 43 into the fuel tank 20. The discharge lines 60 are disposed at the injection valves 34 in such a manner that the fuel supplied via the injection lines 33 to each injection valve 34 flows through the injection valve and subsequently proceeds into the particular discharge line 60.

The mode of operation of the fuel injection system described herein is as follows.

Within a relatively short time after the internal combustion engine is turned off, the fuel pressure in the fuel injection system has dropped to such an extent that the reservoir member or diaphragm 51 of the reservoir 50 assumes a position in which the pressure switch 54 assumes the illustrated position, at which time it then connects the electrical circuit 55 of the electromagnet 65 with the connecting line 57. If the ignition switch 58 of the engine is now closed, then the electromagnet 65 is energized and thus the flushing valve 59 and the discharge lines 60 from the injection valves 34 to the return flow line 43', 43 are opened. Simultaneously with the closing of the ignition switch 58, the electrical circuit of the electric fuel pump 19 is closed, so that the fuel pump 19 supplies fuel out of the fuel tank 20 via the fuel supply line 23 into the first chambers 26 and subsequently via the uncoupling throttle 37 into the control pressure line 36 and on the other side via the flushing line 47 into the pressure chamber 39 and from there into the second chambers 30 of the control valves 26, 30, 33. From the second chambers 30 of the control valves, the fuel, controlled by the diaphragm 27, proceeds into the injection lines 33 and the injection valves 34 and from there into the discharge lines 60 to the flushing valve 59, via which the fuel proceeds into the return flow line 43', 43. A pressure control 69 can be disposed in the return flow line 43' which maintains a flushing pressure which is greater than the fuel vapor pressure, so as to prevent the formation of new fuel vapor bubbles in the hot system as well. Simultaneously, the reservoir 50 begins to fill and the reservoir member 51 moves against the force of the compression spring 52 toward the right as seen in the drawing and upon reaching a predetermined filling status actuates the pressure switch 54 in such a manner that the electrical circuit 55 of the electromagnet 65 is opened and the flushing valve 59 closes. Simultaneously with the interruption of the connection with the electrical circuit 55, the pressure switch 54 closes an electrical circuit 61 of the starter motor 62 of the internal combustion engine, which now, with a closed starter switch 63, begins to run and starts the internal combustion engine. The air for combustion now induced by the internal combustion engine moves the air flow rate member 3 against the force of the compression spring 45 in the opening direction, as a result of which the control slide 14 is lifted to such an extent that the front face 16 of the control slide 14 closes both the discharge opening of the flushing line 47 and the discharge opening of the flushing channels 48 into the pressure chamber 39 and a fuel quantity corresponding to the induced air quantity can be metered out between the annular groove 28 and the control slits 29.

The embodiment of the fuel injection system in accordance with the invention thus assures that all the lines and units of the fuel injection system are flushed with fuel before the engine is started and thus are filled, so that difficulties in starting the engine as a result of insufficient fuel supply are effectively prevented. The flushing time before the engine is started is determined by means of the reservoir 50 depending on the degree of evacuation or of vaporization in the lines. The reservoir 50 thus represents a timing device and is designed in such a manner that a pressure prevails in the injection lines 33 during the flushing process which is below the opening pressure of the injection valves 34.

Figure 2:
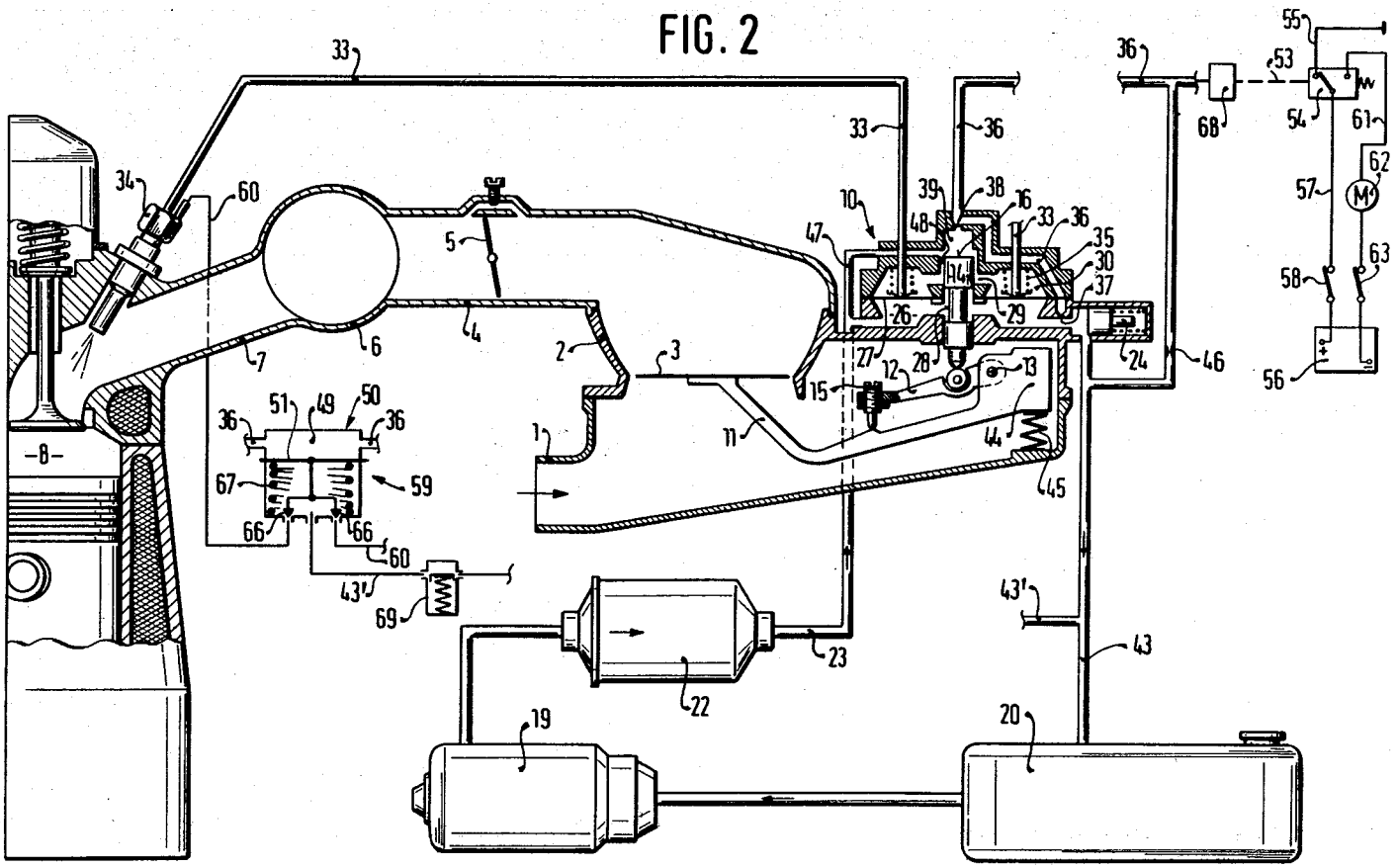
FIG. 2 is a second exemplary embodiment of a fuel injection system.

Turning now to the second exemplary embodiment of the fuel injection system shown in FIG. 2, the elements thereof which are identical to those of the first embodiment of FIG. 1 are given the same reference numerals. In this view, the movable reservoir member 51 of the reservoir 50 disposed in the control pressure line 36 is directly coupled to the movable valve elements 66 of the flushing valve 59 and can move these elements against the force of a flushing spring 67 in the closing direction. As in the first exemplary embodiment of FIG. 1, the reservoir 50 serves in the second embodiment of FIG. 2 as a timing device, which below a certain fuel pressure in the control pressure line 36 holds the flushing valve 59 open, so that the fuel injection system is flushed with fuel after the actuation of the ignition switch 58 until such time as the predetermined fuel pressure in the control pressure line 36 is exceeded and the reservoir member 51 closes the flushing valve 59. Simultaneously with exceeding the predetermined fuel pressure in the pressure control line 36, the pressure switch 54 is displaced by a pressure-sensing member 68, a pressure capsule, for instance, via an actuation member 53 shown in broken lines into a position in which it closes the electrical circuit 61 of the starter motor 62, which now, with a closed starting switch 63, begins to run. The subsequent function corresponds to that described in connection with FIG. 1.

Compared with the first exemplary embodiment of this invention, the second exemplary embodiment thereof is simplified by means of the direct coupling of the reservoir 50 to the flushing valve 59 and enables easy exertion of the closing force onto the flushing valve 59 by means of an appropriately large embodiment of the reservoir member 51.

The foregoing relates to preferred embodiments of the invention, it being understood that other embodiments and variants thereof are possible within the spirit and scope of the invention, the latter being defined by the appended claims.

What is claimed and desired to be secured by Letters Patent of the U.S. is:

1. A fuel injection system for mixture-compressing, externally ignited internal combustion engines arranged to inject fuel into an intake manifold, said system including an air flow rate-responsive member and an arbitrarily actuatable throttle valve, said air flow rate-responsive member being moved in accordance with the quantity of air flowing therethrough and arranged to displace a control slide mounted in a metering and distribution valve disposed in a fuel supply line and thereby meter a quantity of fuel from a predetermined point which corresponds to the air quantity, said metering operation arranged to take place at a constant pressure difference in that one control valve each is inserted into the fuel flow downstream of said metering points, further wherein each said valves have a flow passage cross section which is variable by means of a yielding member which defines plural, pressurized chambers, said pressure within said chambers adapted to move said yielding member in the direction of opening the control valves, further wherein said control slide includes an end face which projects into another pressure chamber to open a flushing line which communicates with flushing channels that branch off from said fuel supply line, said flushing line and flushing channels being arranged to connect said other pressure chamber with said control valves and further that downstream of an uncoupling throttle a hydraulic reservoir is disposed in a control pressure line, said reservoir including a diaphragm arranged to open a flushing valve which in turn opens an outlet line from each individual injection valve to a return flow line and wherein above a certain fuel pressure the electrical circuit of a starter motor is closable by means of an electrical pressure switch actuatable in accordance with the fuel pressure in the control pressure line.

2. A fuel injection system in accordance with claim 1, further wherein said flushing valve includes movable valve elements which are actuatable in the closing direction directly by said diaphragm of said hydraulic reservoir against the force of a flushing spring.

3. A fuel injection system in accordance with claim 1, further wherein said electrical pressure switch is actuatable by said diaphragm in such a manner that below said certain fuel pressure in said control pressure line the electrical circuit of an electromagnet is arranged to open said flushing valve so as to then open the outlet lines from each individual injection valve to said return flow line and further that above said certain fuel pressure in said control pressure line the electrical circuit of the electromagnet is interrupted and thus the flushing valve is closed.

4. In a fuel injection system for mixture-compressing, externally ignited internal combustion engines including: an intake manifold; an air flow rate member located in the intake manifold and displaceable therein in accordance with the quantity of air flowing through the intake manifold; a fuel metering and distribution valve; fuel supply means for supplying fuel to the fuel metering and distribution valve; and a plurality of fuel injection valves, the fuel metering and distribution valve having: means defining a plurality of metering points; a movable control slide displaceable by said air flow rate member, for metering a quantity of fuel corresponding to the air quantity displacing the air flow rate member through the plurality of metering points; a plurality of control valves located downstream of and connected to a respective one of the metering points and to a respective one of the fuel injection valves, and connected to the fuel-supply means; a pressure chamber into which the control slide is displaceable; and a control pressure line connected to the pressure chamber and the fuel supply means; the improvement comprising:

a flushing line connected to the fuel supply means and to the pressure chamber, such that the movement of the control slide adjusts the opening of the flushing line into the pressure chamber;

a flushing channel operatively associated with each control valve, through which the respective control valve is connected to the pressure chamber;

pressure control means connected to the control pressure line;

switching means connected to the pressure control means and to the fuel supply means;

a return flow line connected to the fuel supply means; and a flushing valve connected to the switching means, the return flow line and each fuel injection valve, wherein when the pressure in the control pressure line falls below a predetermined fuel pressure level:

(i) the movable control slide closes the connection of each control valve with its respective metering point and opens the connecting of each flushing channel to the flushing line;

(ii) each fuel injection valve is connected through its respective control valve and flushing channel to the flushing line, which receives fuel from the fuel supply means; and (iii) the pressure in the control pressure line is sensed by the pressure control means and actuates the switching means, which in turn actuates the fuel supply means to supply fuel to the flushing line and adjusts the flushing valve to thereby connect each fuel injection valve through the flushing valve to the return flow line.

5. In the fuel injection ystem as defined in claim 4, wherein the pressure control means comprises a hydraulic reservoir including a movable member and means biasing the movable member against the pressure in the control pressure line.

6. In the fuel injection system as defined in claim 5, wherein the movable member comprises a diaphragm and the biasing means comprises a spring.

7. In the fuel injection system as defined in claim 4, wherein the switching means comprises an electric circuit including an electric pressure switch connected to the pressure control means, a source of electric potential and a manually actuatable switch, and wherein, on one position of the electric pressure switch, the manually actuatable switch connects the electric pressure switch to the source of electric potential.

8. In the fuel injection system as defined in claim 5, wherein the flushing valve comprises an electro-magnetic valve.

9. In the fuel injection system as defined in claim 4, wherein the pressure control means comprises a hydraulic reservoir including a movable member and means biasing the movable member against the pressure in the control pressure line, the flushing valve comprises an electro-magnetic valve, and the switching means comprises an electric circuit including an electric pressure switch connected to the movable member of the hydraulic reservoir and to the electro-magnetic valve, a source of electric potential and a manually actuatable switch which, in one position of the electric pressure switch, connects the electric pressure switch, and thereby the electro-magnetic valve, to the source of electric potential.

10. In combination with a battery and ignition switch of a motor vehicle, a fuel injection system for mixture compressing, externally ignited internal combustion engines, comprising:

air flow rate means for monitoring the quantity of air delivered to the engine;

a fuel metering and distribution valve connected to the air flow rate means;

fuel supply means for supplying fuel to the fuel metering and distribution valve;

a plurality of fuel injection valves;

said fuel metering and distribution valve including: means defining a plurality of metering points; a movable control slide displaceable by said air flow rate means, for metering a quantity of fuel corresponding to the air quantity monitored through the plurality of metering points; a plurality of control valves located downstream of and connected to a respective one of the metering points and to a respective one of the fuel injection valves, and connected to the fuel supply means; a pressure chamber into which the control slide is displaceable; and a control pressure line connected to the pressure chamber and the fuel supply means;

a flushing line connected to the fuel supply means and to the pressure chamber, such that the movement of the control slide adjusts the opening of the flushing line into the pressure chamber;

a flushing channel operatively associated with each control valve, through which the respective control valve is connected to the pressure chamber;

pressure control means connected to the control pressure line;

switching means connected to the pressure control means and to the battery through the ignition switch;

a return flow line connected to the fuel supply means; and a flushing valve connected to the switching means, the return flow line and each fuel injection valve, wherein when the pressure in the control pressure line falls below a predetermined fuel pressure level and the ignition switch is closed:

(i) the movable control slide closes the connection of each control valve with its respective metering point and opens the connection of each flushing channel to the flushing line:

(ii) each fuel injection valve is connected through its respective control valve and flushing channel to the flushing line, which receives fuel from the fuel supply means; and (iii) the pressure in the control pressure line is sensed by the pressure control means and actuates the switching means, which in turn actuates the fuel supply means to supply fuel to the flushing line and adjusts the flushing valve to thereby connect each fuel injection valve through the flushing valve to the return flow line.

11. The combination as defined in claim 10, wherein the pressure control means comprises a hydraulic reservoir including a movable member and means biasing the movable member against the pressure in the control pressure line.

12. The combination as defined in claim 11, wherein the movable member comprises a diaphragm and the biasing means comprises a spring.

13. The combination as defined in claim 10, wherein the switching means comprises an electric circuit including an electric pressure switch connected to the pressure control means, the battery and the ignition switch, and wherein, in one position of the electric pressure switch, the ignition switch connects the electric pressure switch to the battery.

14. The combination as defined in claim 10, wherein the flushing valve comprises an electro-magnetic valve.

15. The combination as defined in claim 10, further comprising:

the starting switch and starting motor of the motor vehicle, wherein:

(iv) the starting switch and starting motor are connected in series with the battery and the pressure control means.

* * * * *